United States Patent [19]

Vazquez

[11] Patent Number: 4,527,631

[45] Date of Patent: Jul. 9, 1985

[54] SUBSURFACE SAFETY VALVE

[75] Inventor: Gonzalo Vazquez, Houston, Tex.

[73] Assignee: AVA International Corporation, Houston, Tex.

[21] Appl. No.: 531,413

[22] Filed: Sep. 12, 1983

[51] Int. Cl.[3] ..... E21B 34/10; E21B 23/03

[52] U.S. Cl. ..... 166/322; 166/117.5; 166/324

[58] Field of Search ..... 166/117.5, 319, 322, 166/324

[56] References Cited

U.S. PATENT DOCUMENTS 3,078,923 2/1963 Tausch ..... 166/224

3,777,813 12/1973 Dendy ..... 166/72

4,325,431 4/1982 Akkerman ..... 166/117.5

*Primary Examiner*—Stephen J. Novosad

*Assistant Examiner*—Michael Starinsky

*Attorney, Agent, or Firm*—Vaden, Eickenroht, Thompson & Jamison

[57] ABSTRACT

There are disclosed two embodiments of a subsurface safety valve having operating means which is responsive to the supply of control fluid from a remote source for holding a closure member in open position and which is retrievable separately from the closure member, so that with the bore of the mandrel above and below the closure member fluidly disconnected, the closure member automatically closes so as to close in the well when the operating means is so retrieved.

5 Claims, 11 Drawing Figures

32'
56
33 C
22'
7
42
7
33B
T'
40
20'
41'
M'
33
31'
28'
29'
23'
41'

41'
22'
20'
74
47'
31'
28'
29'
23'

SUBSURFACE SAFETY VALVE

This invention relates to a subsurface safety valve having a mandrel connected as part of a tubing string packed off within a well bore and having a bore therethrough to form a continuation of the bore through the tubing string, and means including operating means for respectively opening and closing the mandrel bore in response to the supply of control fluid thereto or the exhaust of control therefrom. More particularly, it relates to an improved subsurface safety valve of the type in which the operating means may be retrieved from the well in order to permit its replacement or repair without having to pull the tubing string.

As well known in the art, valves of this general type are useful in automatically closing the tubing string in the event of an abnormal condition, such as shearing of the tubing string and the line through which control fluid is supplied to the operating means. In the particular type of subsurface safety valve referred to above, there may also be a need to close in the well when the operating means is retrieved, even though temporarily, for replacement or repair.

As shown and described, for example, in U.S. Pat. No. 3,078,923, in one version of this latter type of safety valve—i.e., in which the operating means is retrievable without pulling the tubing string—the mandrel bore is opened and closed by a closure member connected to and retrievable with the operating means. Consequently, the bore through the mandrel is left open, and the well is not under control, as the need for retrieving the operating means arises.

In another version of this type of safety valve, such as shown in U.S. Pat. No. 4,325,431, the operating means comprises a tool which is run into and out of a pocket to the side of the mandrel bore separately of the closure member, whereby, with the tool in place, there is less restriction of the bore of the mandrel than in the mandrel of the above described valve of this type. The bore of the mandrel above and below the closure member is connected by means including a passageway in the mandrel which is controlled by valve means carried by the operating tool so as to close the connecting means, until control fluid is supplied to the operating means of the tool, and then open the connecting means in order to equalize pressure across the closed closure member in order to facilitate its opening by a fluid responsive piston within the tool. However, even though the closure member automatically closes the mandrel bore as the operating tool is retrieved, the passageway is left open by removal of the equalizing valve means with the operating tool, so that in this case also the well is not closed in during the time the operating means is retrieved.

The primary object of this invention is to provide a subsurface safety valve of the type wherein the operating means is retrievable, as in the valves above described, but in which the well is automatically closed in when the operating means is so retrieved.

Another object is to provide such a valve wherein, similarly to the second-described valve of this type, the operating means comprises a tool which is received in a side pocket mandrel, whereby the bore of the mandrel is not severely restricted.

A further object is to provide a valve of the character defined in the foregoing object in which, in accordance with one embodiment, the operating tool and mandrel thereof are of extremely simple and inexpensive construction.

Yet another object is to provide such a valve in which, in accordance with another embodiment thereof, the tool includes valve means for automatically equalizing pressure across the closure member as control fluid is supplied to the tool in order to open the closure member.

These and other objects are accomplished, in accordance with the illustrated embodiments of the present invention, by a subsurface safety valve which includes, as in the above-described valves of this type, means including operating means for respectively opening and closing the mandrel bore in response to the supply of control fluid thereto from a remote source or the exhaust of control fluid therefrom, together with means through which control fluid may be supplied to the operating means from the remote source, a closure member moveable between position opening and closing the mandrel bore, and means yieldably urging the closure member toward the closed position. However, in accordance with the novel aspects of the present invention, the operating means of each such embodiment is removable from the mandrel separately of the closure member to permit the closure member to be moved to closed position, and the bore of the mandrel above and below the closure member is fluidly disconnected, when such closure member is in closed position and the operating means is so removed from the mandrel, so that the well is closed in.

In the preferred and illustrated embodiments of the invention, the mandrel includes a pocket to one side of the bore, and the operating means comprises a tool adapted to be removably landed in a position within the pocket in which the control fluid may be supplied from its remote source to a pressure chamber therein and thus to a pressure responsive member within the chamber, and having means thereon for moving the closure member to open position and holding it in open position in response to the supply of control fluid thereto. More particularly, each of the mandrel and tool have port means, and the tool carries seal means engageable with the pocket to fluidly connect the port means with one another, when so landed, and thus confine the flow of control fluid into the pressure chamber.

In the first-mentioned embodiment of the invention, the valve is of extremely simple construction in that the mandrel has no passageway which connects the bore above and below the closure member, so that when the tool is retrieved and the closure member is in closed position, the well will be closed in upon retrieval of the tool. More particularly, the operating tool merely includes a pressure responsive member which, following pressuring up of the tubing to move the closure member to open position, and in response to the supply of control fluid thereto, is operable to hold the closure member in open position following pressuring up of the tubing to move it to open position.

In another illustrated embodiment of the invention, the valve is similar to that of U.S. Pat. No. 4,325,431 in that a means including a passageway in the mandrel connects the bore of the mandrel above and below the closure member in its closed position, and the operating tool includes valve means which, when the tool is landed within the mandrel pocket, is responsive to the supply of control fluid thereto to open the connecting means prior to moving of the closure member to open position. More particularly, a normally closed check valve is so mounted in the passageway adjacent the pocket as to be held open when the tool is landed in the pocket but to close when the tool is retrieved, thus closing the passageway and closing in the well during the time the tool is retrieved.

In the drawings, wherein like reference characters are used throughout to designate like parts:

Figure 4:
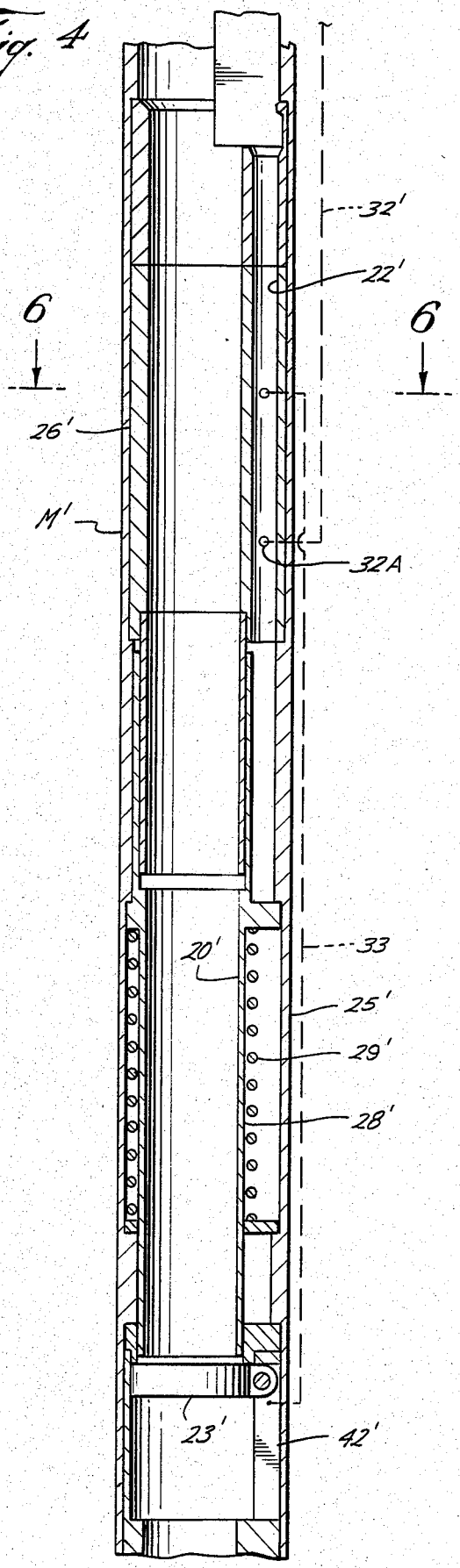
Figure 5:
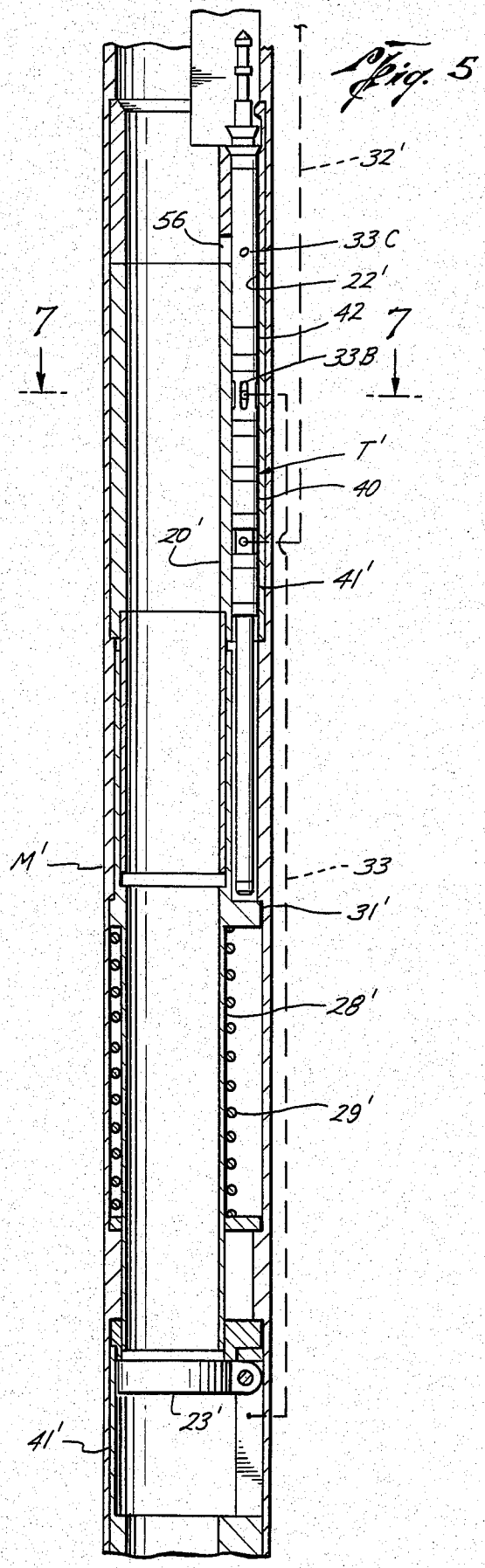
Figure 8C:
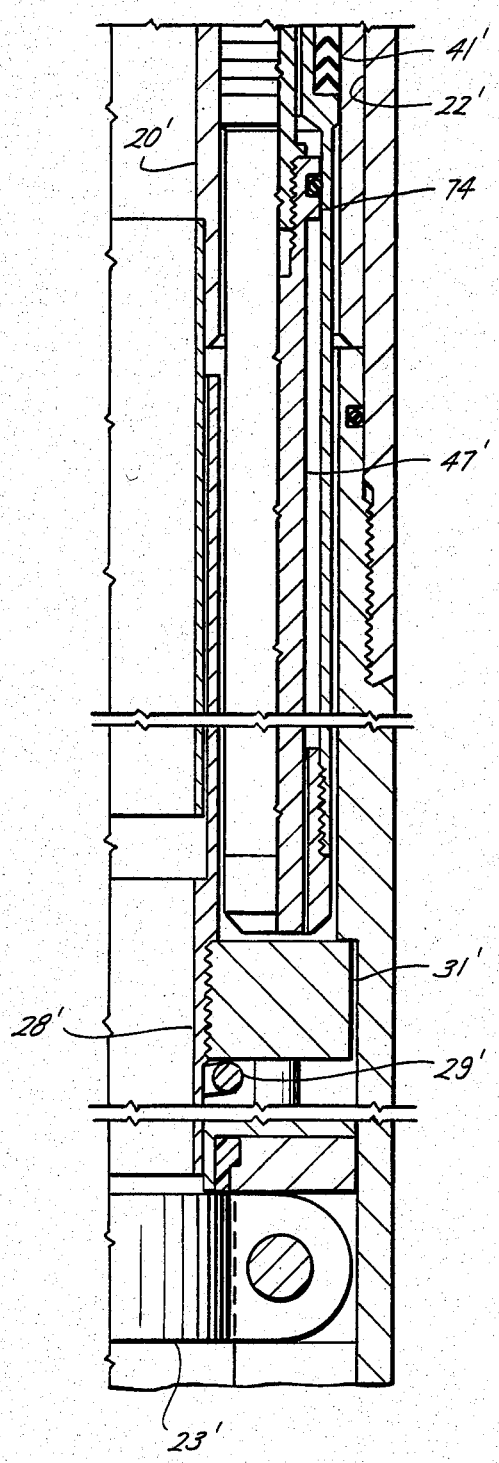
Figure 6:
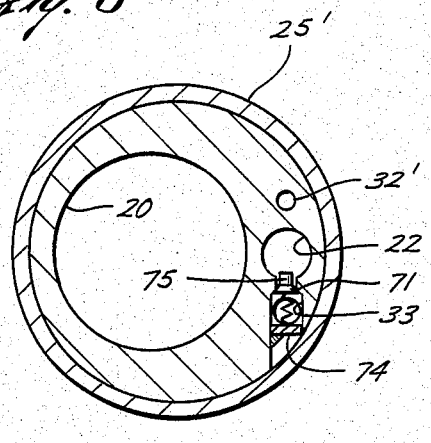
Figure 7:
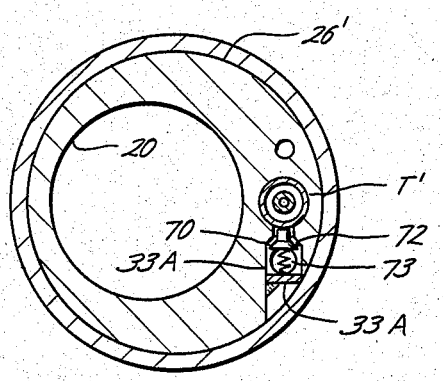
Figure 9:
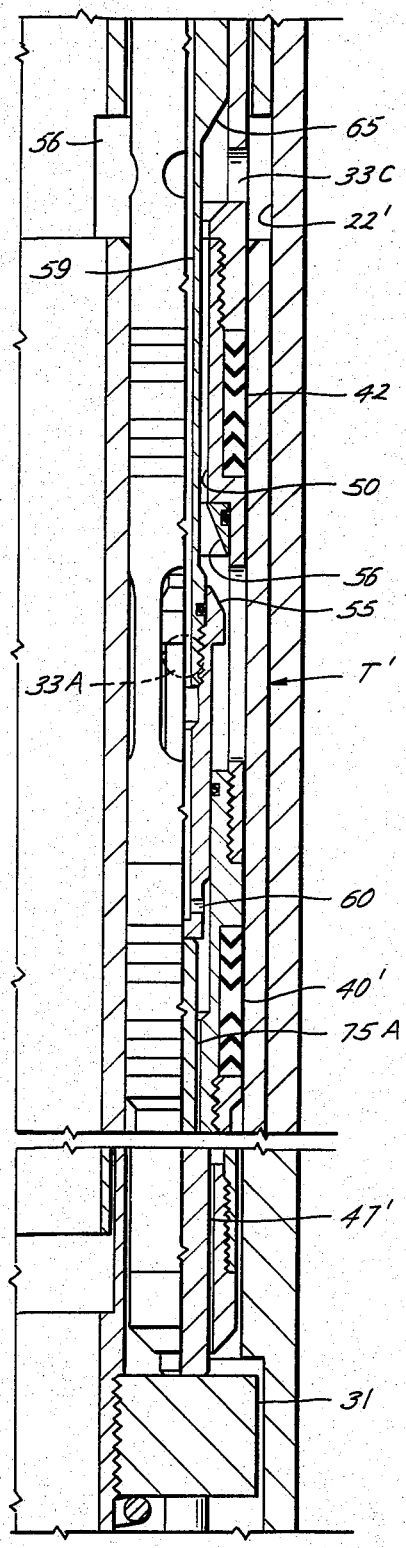
Figure 8A:
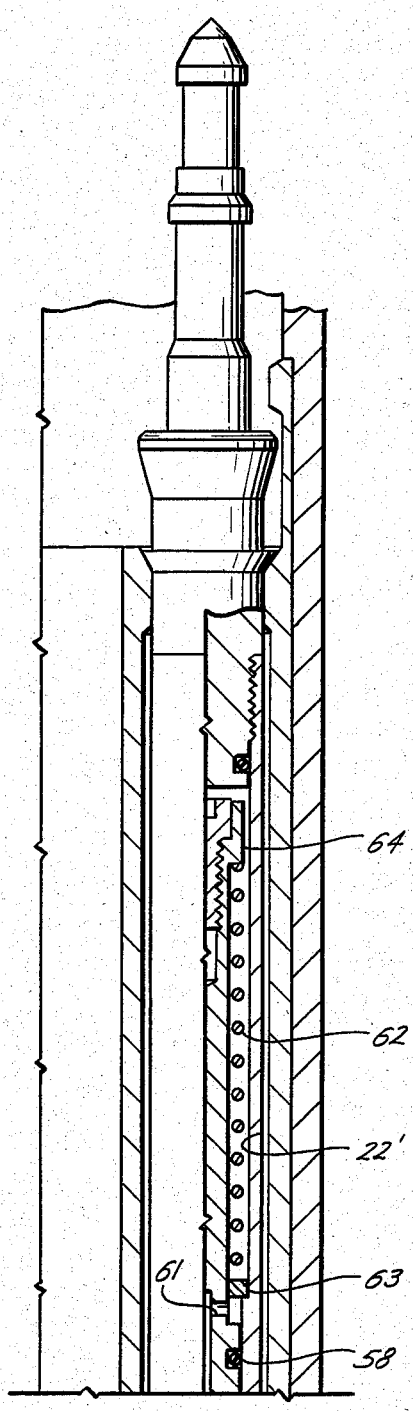
Figure 8B:
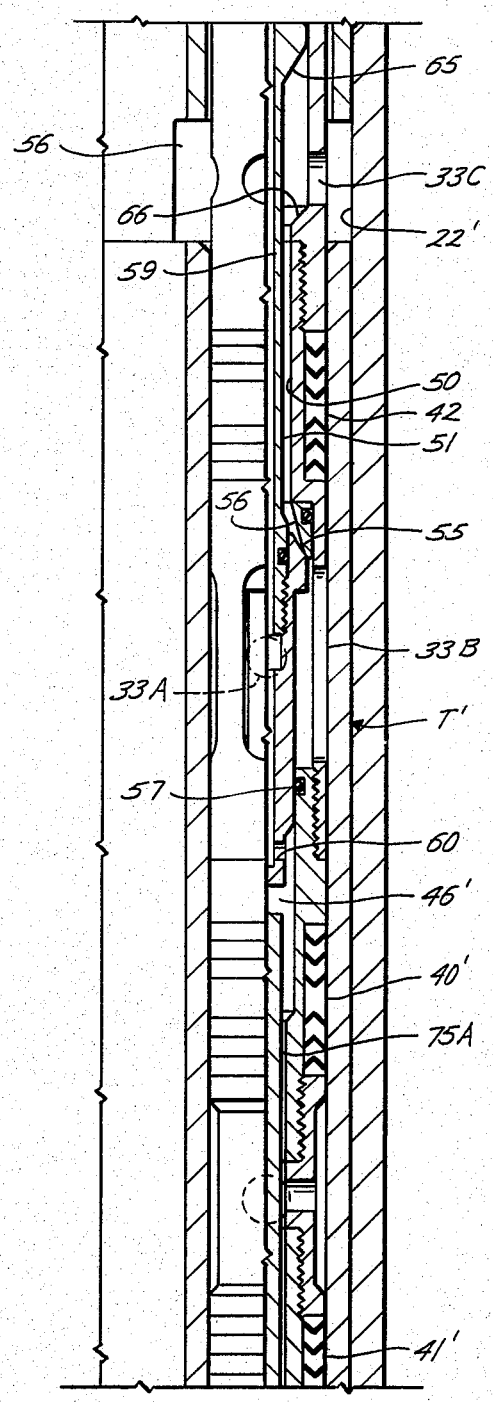

FIG. 4 is a vertical sectional view of the second-described embodiment of a safety valve constructed in accordance with the present invention, with the closure member thereof in closed position and with the operating tool removed from the side pocket of the mandrel bore, the broken lines indicating a control line through which control fluid may be supplied to the operating tool, as well as a passageway connecting the bore of the mandrel beneath the closure member with the pocket and thus the bore above the closure member;

FIG. 5 is a view similar to FIG. 4, but upon landing of the operating tool in the pocket in such a position that control fluid may be supplied thereto so as to move the closure member to open position and hold it in open position, and also open valve means therein to connect the bore of the mandrel above and below the closure member, and thereby equalize pressure prior to actuation of the pressure responsive member of the tool to open the closure member;

FIG. 6 is a cross-sectional view of the valve as seen along broken lines 6—6 of FIG. 4;

FIG. 7 is a cross-sectional view of the valve as seen along broken lines 7—7 of FIG. 5;

FIGS. 8A, 8B and 8C are enlarged vertical sectional views of the upper, intermediate and lower portions of one side of the valve, as shown in FIG. 5; and FIG. 9 is a vertical sectional view of one-half of the intermediate and lower portions of the valve, similar to FIGS. 8B and 8C, but upon the supply of control fluid to the equalizing valve of the tool so as to equalize pressure across the closed closure member.

Figure 1:
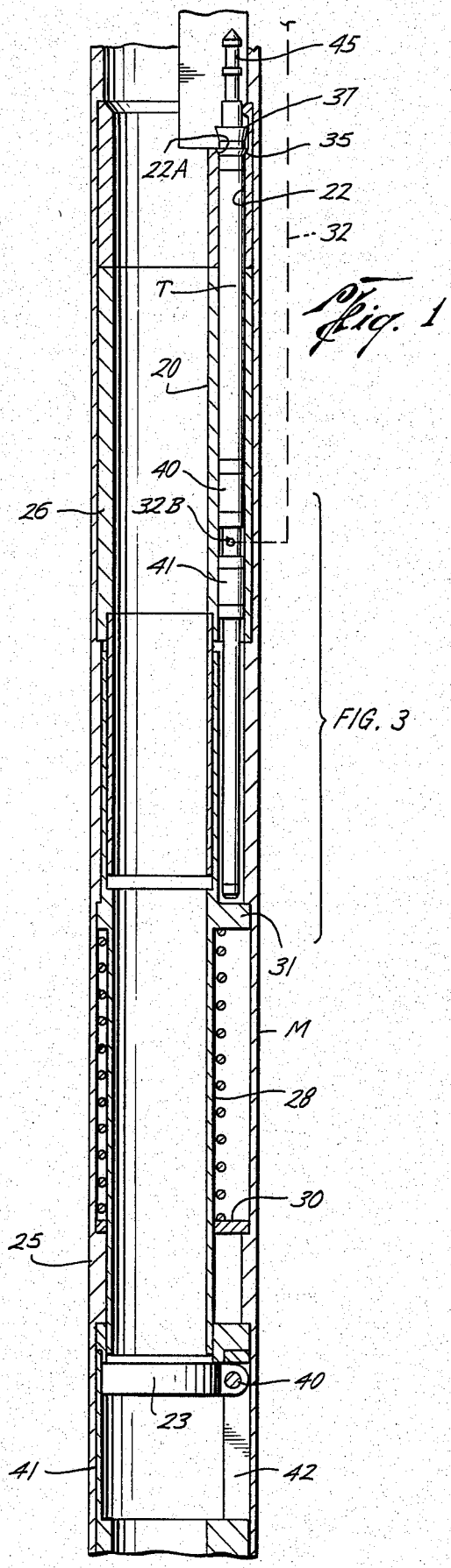
FIG. 1 is a vertical sectional view of the first-described embodiment of a subsurface safety valve constructed in accordance with the present invention, and showing the closure member in closed position and the operating tool landed within the pocket to one side of the mandrel bore.
Figure 2:
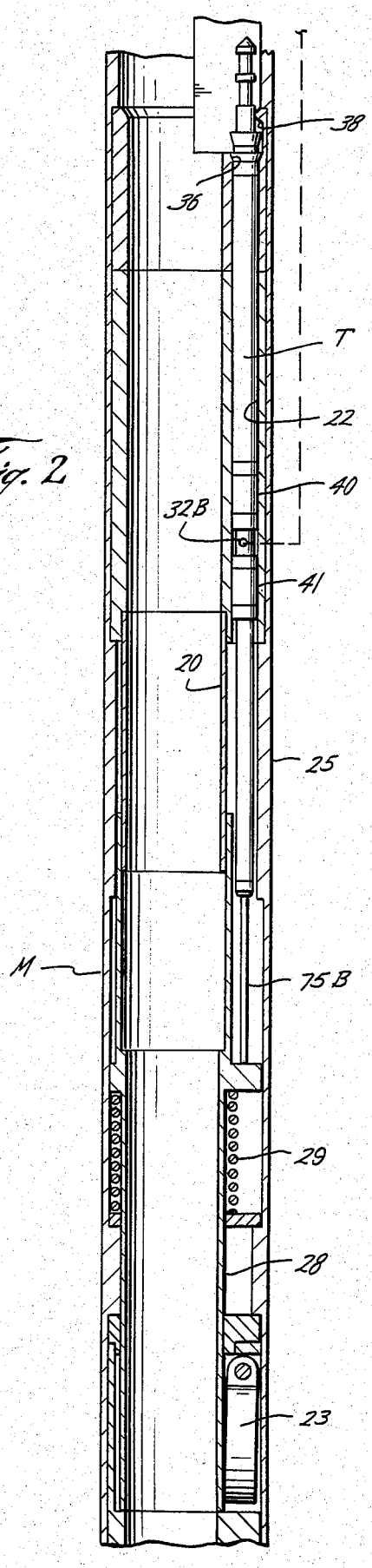
FIG. 2 is a view similar to FIG. 1 but upon supply of control fluid to the operating tool through a control line shown in broken lines in order to move the closure member to open position and hold it in open position until the control fluid is exhausted.

With reference now to the details of the above-described drawings, the overall valve of the first embodiment of the invention is shown diagrammatically in FIGS. 1 and 2 to include a mandrel M adapted to be connected as part of a well string (not shown) and having a bore 20 therethrough which, when the mandrel is so connected, is axially aligned with the well string. The valve also includes a closure member 23 mounted in the mandrel for movement between positions opening and closing a seat about the bore 20, and a tool T for use in operating the valve when landed in a pocket 22 of the mandrel to one side of the bore, as shown in FIGS. 1 and 2. The well string will, as a general rule, be the tubing string of an offshore oil or gas well, and the mandrel will be connected as part of the tubing string at just below the mud level.

The closure member 23 is a flapper which is normally urged by a spring (not shown) to closed position, as shown in FIG. 1, but which, when moved to open position, as shown in FIG. 2, provides a full opening through the bore of the mandrel and the tubing string to permit wire line operations below the valve. The upper end of the pocket 22 is open, so that, in the event one or more parts of the operating tool, and especially the dynamic seals thereof, require replacement or repair, the tool need only be retrieved from the pocket 22, and then, when reconditioned, run back through the bore of the mandrel into landed position within the pocket, all in accordance with conventional wire line procedures.

As in the case of the valve of U.S. Pat. No. 4,325,431, the mandrel M includes an outer body 25 which is made up of sections connected in end-to-end relation, with the upper and lower ends (not shown) having axially aligned openings forming the upper and lower ends of the bore 20, and an intermediate section having an inner diameter which is radially enlarged and eccentric to the axes of the end openings in the upper and lower sections. The mandrel also comprises an inner body 26 having an outer diameter which fits closely within the inner diameter of the upper portion of the intermediate outer body section, and a bore therethrough which is axially aligned with the upper and lower sections of the outer body to form a continuation of bore 20. As shown, the pocket 22 of the mandrel is formed in the inner body to one side of its bore and thus of the mandrel bore 20.

The valve actuator comprises a tube 28 which is axially reciprocable within the outer mandrel body and beneath inner body 26 between an upper position (FIG. 1) in which its lower end is above the flapper 23, and a lower position (FIG. 2) in which it extends downwardly through the seat in the bore to open and hold the flapper to one side of the bore. In this latter position, the tube provides a substantially smooth continuation of the bore 20 through the mandrel.

A coil spring 29 is disposed within the annular space between the actuator tube 28 and the inner diameter of the outer mandrel body, with the upper end of the spring engaging a ring 31 carried by the tube 28 and its lower end engaging a ring or collar 30 supported on an upwardly facing shoulder of the outer mandrel body so as to urge the tube to its upper position and thus permit the flapper to close. As shown in FIG. 1, when the operating tool T is landed within the side pocket 22, its lower end is disposed just above the ring 31 on the actuator tube so that when a piston is extended therefrom in response to control pressure, it will move the tube downwardly against the force of the spring 29 in order to open the closure member.

Control fluid for extending the piston, and thus operating the closure member, is supplied to a pressure responsive area of the piston within a control pressure chamber of the tool through a conduit 32 extending downwardly from a suitable source at the surface for connection at its lower end with the side pocket. Conduit 32 includes a tube extending downwardly along the side of the tubing and connecting at its lower end with a drilled hole in the thickened wall of the inner mandrel body. A port 32A at the lower end of the conduit 32 connects with the pocket 22 at a level opposite a port 32B (FIG. 3) in the landed tool T intermediate lower packings 40 and 41, respectively, about the body of the tool.

The upper end of tool T is specially prepared to receive releasable parts of a suitable wire line running tool, which, for example, may be of a type shown in U.S. Pat. No. 3,827,490. As described in U.S. Pat. No. 4,325,431, the bore 20 of mandrel M is prepared to cooperate with the running tool, during running of the operating tool T, to kick the operating tool over into a position above the upper end of the pocket 22, or, alternatively, during pulling of the operating tool T from the pocket, to kick the tool over into the mandrel bore.

As the operating tool is lowered into pocket 22, a shoulder 35 thereabout lands upon a seat about the pocket, and a collar 37 beneath the neck at its upper end moves beneath an inner groove 38 formed in the upper end of the inner body 26 of the mandrel so as to limit upward movement of the tool from its landed position.

The flapper 23 is pivotally mounted on a pin 40 carried by the thickened wall of a housing 41 received within the outer mandrel body for swinging into and out of a slot 42 in the housing beneath the pin. When disposed within the slot, the flapper is out of the way of actuator tube 28 to permit the tube to move through the bore of the housing and thus, when fully lowered, to form a continuation of the bore. As shown in U.S. Pat. No. 4,325,431, the pivot pin 40 is surrounded by a torsion spring which bears at one end of the flapper and at the other end on the housing 41 so as to yieldably urge the flapper to the closed position.

Operating tool T comprises a generally tubular body depending from the lower end of a fishing neck 45 at its upper end. Upper and lower packings 40 and 41, respectively, are carried about the tool body above and below part 32B for sealably engaging with the pocket 22 when the tool is landed therein above and below the port 32A in the mandrel so as to confine the flow of control fluid from conduit 32 into a pressure chamber 46 (FIG. 3) within the tool which is closed at its lower end by the pressure responsive surface on the upper side of a piston 47 sealably slidable within the tubular body, and at its upper end above ports 32B.

Figure 3:
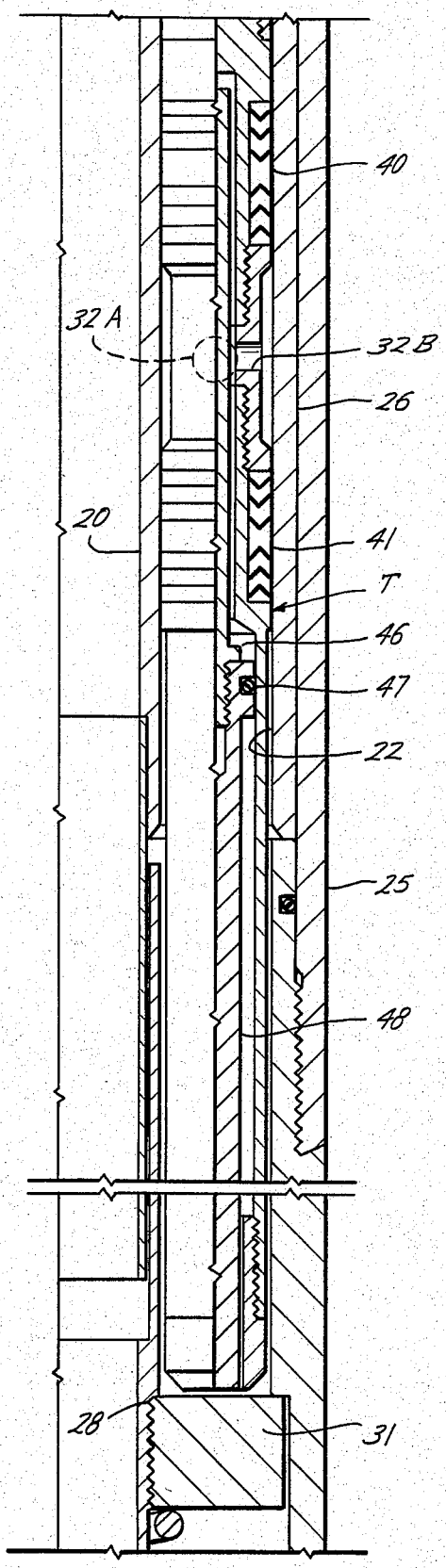
FIG. 3 is an enlarged vertical sectional view of the portion of FIG. 1 indicated by a bracket, and showing the pressure chamber and pressure responsive member of the tool in partial cross section.

As shown in FIGS. 1 and 3, the lower end of the body of the tool T extends below the pocket into the space between tube 28 and the inner diameter of the outer mandrel body, and terminates just above collar 31 of the tube when the tube is raised to permit flapper 23 to close. As shown in FIG. 3, a rod 48 on the lower end of piston 47 extends downwardly within the lower end of the tubular body of the operating tool for reciprocation between an upper, retracted position in which its lower end is substantially flush with the lower end of the tool body (FIG. 3), and a lower, extended position in which its lower end projects beyond the lower end of the tool body to lower the actuator tube 28 in order to open the flapper, as shown in FIG. 2. As also shown in FIG. 3, the lower ends of both the tool body and piston extension are spaced a short distance above the upper end of collar 31 on the actuator sleeve to enable the operating tool to be landed without preloading the spring 29.

As will be understood, piston 47 has oppositely facing, pressure responsive surfaces of equal area on its upper and lower sides which are acted upon by control fluid and well fluid within the well tubing above the flapper, respectively. Thus, as control fluid is supplied to chamber 46 at a pressure sufficient to overcome the force due to pressure in the tubing, the lower end of the piston will be extended below the lower end of the tool body to engage the collar 31. At this time, however, the upward force which the well tubing pressure beneath the flapper is exerting on the closed flapper may prevent further downward movement of the actuator tube until the pressure across the flapper is equalized.

Thus, with the lower end of the actuator tube 28 engaged with the top side of the closed flapper 23, the tubing string is pressured up above the flapper so as to move the flapper away from the seat in the mandrel bore. This quickly equalizes pressure across the flapper, so that the force due to the piston 47 is effective to swing the flapper into its open position, and hold it in such position, whereby pressurizing of the tubing string may be discontinued. Thus, as in the case of the valve of U.S. Pat. No. 4,325,431, the valve is "fail safe" in the sense that the flapper will either remain closed or, if open, as above described, will close automatically in response to abnormal conditions, including the loss of control fluid, as may occur upon shearing of the tubing and control fluid conduit 32, whereby water would enter the lower portion of the control line and thus the control chamber 46, and/or by the failure of one or more of the seals carried by or within the operating tool such that well fluid in the tubing beneath the flapper entered the control chamber.

As previously described, the absence of a passageway in the mandrel connecting the mandrel bore beneath the flapper with the pocket 22 (and thus the mandrel bore above the flapper) enables the well to be shut in despite removal of operating tool T from the pocket. In addition, the valve is simple construction in that the tool merely requires a body containing an actuating piston and a pressure control chamber on one side of the piston to receive control fluid.

The embodiment of the valve shown in FIGS. 5 to 9 is similar in many respects to the above-described valve, as indicated by the ports thereof which use the same reference numbers, plus a prime. In other respects, however, the valve of FIGS. 5 to 9 is more like that of U.S. Pat. No. 4,325,431; and, in fact, except for the novel improvements previously mentioned and to be described in detail, may be identical to that of the patented valve.

Thus, for example, as indicated by the broken lines of FIGS. 4 and 5, the valve includes, in addition to control line 32' connecting at port 32A' with pocket 22', a passageway 33 in the mandrel having a port 33A for connecting the pocket above the port 32A' with the bore of the mandrel beneath flapper 23'. Thus, as shown in FIG. 5, slots 33B are formed in the body of operating tool T' intermediate packings 42 and 40' thereabout so that, with the tool landed in pocket 22, port 33B is connected to an annular conduit 50 within the tool. The upper end of the conduit is in turn connected to a port 33C in the tool which leads to the mandrel bore above the flapper.

The conduit 50 is normally closed by valve means (to be described) which is adapted to be opened in response to the supply of control fluid in control chamber 46'. Upon opening of the valve means, well fluid beneath the flapper is free to flow through the passageway 33 as well as the tool conduit 50 into the bore of the mandrel above the flapper so as to equalize pressure across the closed flapper. As previously described, this enables the piston 47' to be freely extended by control fluid in chamber 46 in order to lower actuator tube 28' through the seat and thereby open the flapper and hold it in open position.

The portions of control fluid conduit 32' and tubing pressure equalizing conduit 33 which connect with pocket 22' include holes drilled in the thickened wall of the inner mandrel body on opposite sides of the pocket (see FIGS. 6 and 7). As shown in U.S. Pat. No. 4,325,431, the lower end of conduit 33 may comprise a tube connected at its upper end to the lower end of the drilled hole and extending downwardly within a space between the actuator tube and the outer mandrel body (see FIGS. 8C and 9) to connect with a port in the mandrel housing opening to the recess 42' of flapper housing 41' in which the open flapper is received. The upper and intermediate packings 42 and 40' surround the tool body above and below the slots 33B therein and sealably engage the pocket above and below the port 33A, when the tool is landed in the pocket. The upper packing 42 surrounds the tool body beneath port 33C and seals with the pocket 22' beneath the cutout 56. Thus, as will be described to follow, when the equalizing valve is open, well fluid in the tubing beneath the flapper is confined for flow into the tubing above the flapper.

As shown in FIGS. 8A and 8B, port 32B' in the tubular body of the operating tool connects with control fluid chamber 46' whose upper end includes a dome in the tool body beneath the fishing neck thereof. The equalizing valve includes a body 51 which is sealably slidable longitudinally within the tool body for reciprocation above the piston 47 between positions opening and closing annular conduit 50 between the body 51 and the inner diameter of the tubular tool body. More particularly, and as will be described to follow, the tubular body of the equalizing valve 51 is reciprocated between opened and closed positions in response to the pressure of control fluid within the chamber 46.

As shown in FIG. 8B, an intermediate portion of the equalizing valve 55 is radially enlarged to provide a shoulder 55 which, in the closed position of the equalizing valve, engages the lower end of a seat 56 on the inner diameter of the tool body just above slots 33B. The lower end of the equalizing valve body beneath shoulder 51 slides within an O-ring 57 carried on the inner diameter of the tool body beneath the slots 33B, and a radially enlarged portion of the equalizing valve body above shoulder 55 carries a seal ring 58 (FIG. 8A) which sealably engages the inner diameter of the tool body above the ports 33C. A passageway 59 through the equalizing valve connects with ports 60 in its lower end beneath O-ring 57 and with ports 61 (FIG. 8A) in an intermediate portion thereof above O-rings 58, so as to provide a bypass for control fluid between the lower end of the chamber 46' below the valve to the dome at the upper end of the chamber.

For purposes which will be understood from the description to follow, the equalizing valve is yieldably urged to its upper seated position by means of a coil spring 62 arranged within the upper annular portion of the upper end of control chamber between the upper end of the equalizing valve and the tubular extension of the body of the operating tool beneath the fishing neck at its upper end. As shown in FIG. 8A, the lower end of the coil spring engages a ring 63 seated upon an upwardly facing shoulder on the inner diameter of the tool body, and the upper end of the spring engages a shoulder on the lower end of an enlarged head 64 of the equalizing valve.

The outer diameter of the O-ring 58 is larger than the inner diameter of the O-ring 57 so that control fluid is effective over an annular cross-sectional area to urge the equalizing valve in a downward direction. The area of the seating surface of the shoulder 55 of the equalizing valve is larger than either of the aforementioned areas, so that, with the flapper closed, the pressure of well fluid in the tubing beneath the flapper will urge the equalizing valve in an upward direction to seat with a force equal to such pressure times the difference in area between the seating surface and the inner diameter of O-ring 56, plus the force of the spring 62 urging the equalizing valve body in an upward direction. Hence, even if the upward force of the spring 62 is ignored, the tubing pressure below the closed flapper will maintain equalizing valve closed until control pressure has been raised to a level sufficiently higher than that of the tubing pressure (depending on the relationship of the areas of the seating surface and within the O-ring 57), and, in any event, to a level higher than that required to move the piston 47' downwardly to cause the actuator tube to engage the top of the flapper. Thus, as described in connection with the valve of FIGS. 1 to 3, the piston is so moved in response to a control pressure which may be only slightly greater than that of tubing pressure above the flapper, which in turn is normally substantially less than tubing pressure beneath the flapper.

With the lower end of the actuator tube 28' engaged with the top side of the closed flapper 23', as shown in FIG. 9, and control pressure raised to move the equalizing valve body downwardly, and thus open the lower end of conduit 50, well fluid in the tubing beneath the flapper begins to flow through the conduit 50 through ports 33C and into the bore of the mandrel above the flapper, whereby pressure in the tubing above and below the flapper begins to equalize. As will be understood from the description to follow, downward movement of the equalizing valve 51 is limited by engagement of its lower end with the upper end of piston (see FIG. 9) so that the tubing pressure continues to equalize, whereby the piston 47' is able to extend further so as to lower actuator tube 28' and thus swing flapper 23' to open position, as shown in FIG. 5. As the piston is lowered, the equalizing valve also moves downwardly until a tapered shoulder 65 (FIG. 8B) thereabout beneath the O-ring 83 seats upon an upwardly facing tapered seat 66 on the inner diameter of the body of the operating tool just below the ports 33C to reclose the valve.

In accordance with the novel aspects of the above-described embodiment of the present invention, and as shown in FIGS. 6 and 7, a check valve element 70 is mounted within port 33A leading from passageway 33 of the mandrel to pocket 22' for movement between a position closing the port, as shown in FIG. 6, and opening the port, as shown in FIG. 7. As shown, the check valve element has a conical shoulder 71, which in its closed position, engages a conical seat 72 about the port 33A. More particularly, the valve element is urged to closed position by means of a coil spring 73 acting between it and a wall 74 across the outer end of the port. A stem 75 which protrudes from shoulder and into a reduced inner end of the port 33A is of sufficiently smaller diameter than the inner end to permit fluid to flow freely between the passageway 33 and the pocket 22' in the open position of the valving element.

When the tool T is landed within the pocket 22, as shown in FIG. 7, its side engages the inner end of the stem to urge it outwardly against the force of the spring and thus into the open position of FIG. 7 so as to fluidly connect the mandrel bore above and below the flapper. Thus, upon the supply of control fluid to the control chamber of the tool T', the valve means 51 within the tool is caused to open and thereby equalize pressure across the flapper. However, upon removal of the tool from the pocket 22', the valve element 100 is automatically returned to closed position by spring 102 so as to fluidly disconnect the mandrel bore above and below the flapper 23', which has automatically returned to closed position, and thus close the well in.

Thus, the above-described valve accomplishes the broad purposes of the present invention without sacrificing the ability to facilitate opening the flapper by first equalizing pressure thereacross automatically in response to the supply of control fluid to the operating tool. In addition, of course, in its illustrated form, this valve may be constructed with only minor modifications to the valve of U.S. Pat. No. 4,325,431.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in a well having a tubing string packed off within a well bore, a subsurface safety valve which comprises a mandrel adapted to be connected as part of the tubing string and having a bore therethrough to form a continuation of the bore through the tubing string, means including operating means for respectively opening and closing the mandrel bore in response to the supply of control fluid thereto or the exhaust of control fluid therefrom, means through which control fluid may be supplied to said operating means from a remote source, a closure member moveable between positions opening and closing the mandrel bore, and means yieldably urging the closure member toward its closed position, said operating means being removable from the mandrel separately of the closure member to permit the closure member to be moved to closed position, and means fluidly disconnecting said bore of the mandrel above and below the closure member so as to close in the well when said closure member is in closed position and said operating means is removed from the mandrel.

2. A valve of the character defined in claim 1, wherein the mandrel includes a pocket to one side of the bore, and the operating means comprises a tool adapted to be removably landed in a position within the pocket in which control fluid may be supplied thereto from said remote source and having means thereon for moving the closure member to open position and holding it in open position in response to the supply of control fluid thereto.

3. A valve of the character defined in claim 2, wherein each of said mandrel and tool has port means, and said tool carries seal means engageable with the pocket to fluidly connect the port means with one another, when so landed therein, whereby control fluid may be supplied through said port means to said operating means through a control line in the annulus of the well bore.

4. A valve of the character defined in claim 2, including means including a passageway in the mandrel connecting the bore of the mandrel above and below the closure member in its closed position, the tool including valve means which, when the tool is mounted within the mandrel, is responsive to the supply of control fluid thereto to open the connecting means prior to movement of the closure member to open position, and a check valve is so mounted in the passageway adjacent the pocket as to be held open when the tool is landed in the pocket and to close when the tool is removed from landed position in the pocket.

5. A valve of the character defined in claim 2, wherein the tubing string above the closure member may be pressured up to open the closure member, the operating means comprises pressure responsive means for holding the closure member open, after the tubing string is pressured up to open it, and the mandrel precludes flow between the bore above and below the closure member, other than through said bore.

* * * * *